United States Patent [19]

Sineni et al.

[11] Patent Number: 4,607,809

[45] Date of Patent: Aug. 26, 1986

[54] TOILET PAPER HOLDER AND DISPENSER

[76] Inventors: Charles F. Sineni; Debra A. Sineni, both of 214 N. Elmhurst Rd., both of Prospect Heights, Ill. 60070

[21] Appl. No.: 570,815

[22] Filed: Jan. 16, 1984

[51] Int. Cl.[3] ..... B65H 19/04

[52] U.S. Cl. ..... 242/55.3; 242/55.54

[58] Field of Search ..... 242/55.2, 55.3, 55.42, 242/55.53, 55.54; 225/46, 76; 248/227, 339, 304; 312/39, 45

[56] References Cited

U.S. PATENT DOCUMENTS

| | | | |
|---|---|---|---|
| 1,917,641 | 7/1933 | Fairchild | 242/55.3 |
| 2,244,804 | 6/1941 | Robinson | 242/55.2 |
| 2,570,491 | 10/1951 | Scardina | 242/55.54 |
| 3,316,040 | 4/1967 | McGann | 312/45 |
| 4,074,872 | 2/1978 | Marshall, Jr. | 242/55.54 |

*Primary Examiner*—Leonard D. Christian
*Attorney, Agent, or Firm*—Dillis V. Allen

[57] ABSTRACT

An aesthetically pleasing toilet paper holder and roll dispenser for residential use that includes an enclosed vertical tubular body that receives the rolls, with a bracket adapted to fit over the top rim of a conventional residential toilet tank under the tank cover without the need for any special fasteners or wall damage. An actuator rod is slidable in axial slots in the body to shift the rolls upwardly so that the top roll may be easily removed, and the rod may be locked in any desired position by simply rotating the rod 90 degrees.

10 Claims, 8 Drawing Figures

TOILET PAPER HOLDER AND DISPENSER

BACKGROUND OF THE INVENTION

Toilet paper holders and dispensers have found wide use in the last two or three decades in the commercial washroom environment, but as of the present day such dispensers have not gained significant acceptance for residential use mainly because they are costly due to their complex mechanical parts. These commercial dispensers are two general types: one in which the rolls are mounted in a housing axially with respect to one another, and the other in which the rolls are mounted transversely adjacent one another usually horizontally positioned and vertically stacked. In the axially aligned roll dispenser there is usually provided a slidable cover that permits the user to shift the cover axially to uncover the second roll after the first roll has been used. A rather complex mechanism is provided for locking this cover in the desired position and preventing its premature shifting until after the first of the two rolls has been exhausted. The vertically stacked dispenser requires a holder for each of the rolls and a track for the holders that enables them to shift vertically, and a complex ratchet-type mechanism that prevents the upper rolls from prematurely dropping down to the lower dispensing position.

While these and other roll tissue dispensers have found a considerable degree of success in commercial use they have not found any degree of acceptance in the residential market because of their high cost, the special installation required, and also and possibly more importantly because the roll being dispensed is always visible and hence is just as unsightly as present residential single-roll holders.

It is the primary object of the present invention to ameliorate the above noted problems and provide an aesthetically desirable multiple-roll residential toilet paper holder and dispenser.

SUMMARY OF THE PRESENT INVENTION

In accordance with the present invention, an aesthetically pleasing multiple-roll toilet paper holder and dispenser is provided for residential use that permits easy and ready access to a reserve supply of toilet paper rolls immediately adjacent the water closet area. Toward this end the present paper holder and roll dispenser includes a closed end vertically positioned plastic tubular body that receives the rolls, and the body has an integrally molded downwardly opening U-shaped bracket the projects from one side thereof that fits over the top rim of the side of a conventional residential toilet tank under the tank cover to support the holder and dispenser directly on the toilet. Another integral projection extending from the tubular body engages the tank side near the lower end thereof to hold the tubular body in a vertical position. This mounting arrangement enables the present holder and dispenser to be positioned immediately in the toilet area without the need for any damaging wall brackets and without requiring any installation skills whatsoever.

The integral mounting bracket has a recess on its upper surface that receives the depending flange from the tank top so that the bracket itself is almost entirely hidden from view.

The open upper end of the tubular body has a cup-shaped cover that when in place completely conceals the internal rolls from view.

An actuator rod is provided for selectively raising the rolls in the tubular body to the uppermost position slightly above the top edge of the tubular body so that the upper roll may be easily removed when desired. The actuator rod is entirely constructed of plastic and includes a central rectangular rod portion slidable in diametrally opposed axial slots in the tubular body and flat enlarged thumb holder portions on the ends of the rod portion that slide along the outside of the tubular body. The rectangular rod portion has on one cross sectional axis a relatively narrow width that is freely slidable in the axial slots and on its other axis a longer height greater in length than the width of the slots, so that after the user positions the rod in the desired axial position he may rotate the rod 90 degrees wedging the rod in the slots thereby locking the rod in position and holding the upper roll in a dispensing position. While this rod may be locked in any position along the axial length of the slot desired by the user, indicator markings are provided on the sides of the slot that enable the user to lock the rod in a position where the upper roll is slightly above the top of the upper edge of the tubular body so that it may be easily manually grasped. The upper edge of the tubular body also has diametrally opposed recesses that permit a larger portion of the upper roll to be exposed and grasped by the user's hand. The cover has a depending sidewall that covers these recesses from view when the cover is in position.

According to a second embodiment of the present invention, a similar tubular body member is provided with integral dovetail-type brackets that may be fastened to a wall adjacent to the water closet area.

DETAILED DESCRIPTION OF THE PREFERRED EMBODIMENTS

Figure 1:
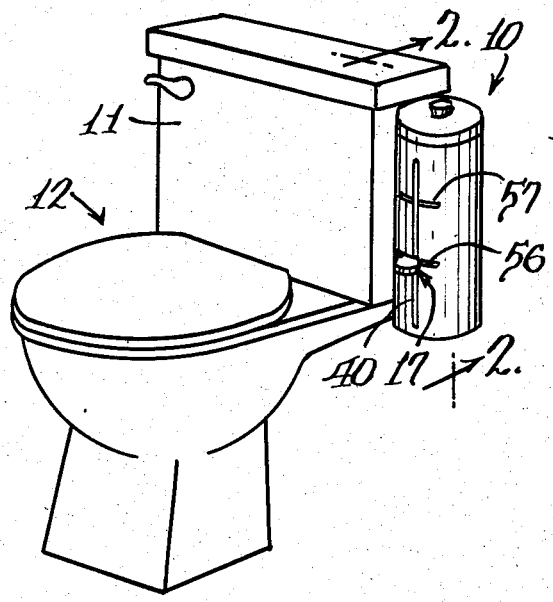
FIG. 1 is a perspective view of a residential water closet with the present toilet paper holder and roll dispenser mounted on the toilet's tank.

Referring to the drawings and particularly the embodiment of the present invention illustrated in FIGS. 1-5, a toilet paper holder and roll dispenser 10 is illustrated attached to a tank 11 of the conventional residential water closet or toilet 12. The toilet paper holder and dispenser 10 is constructed entirely of an injection moldable semi-rigid plastic material such as polypropylene, polyethylene or Delryn and generally includes a tubular body 14 having a cover 15, and integral mounting bracket 16 and an actuator rod 17.

Figure 2:
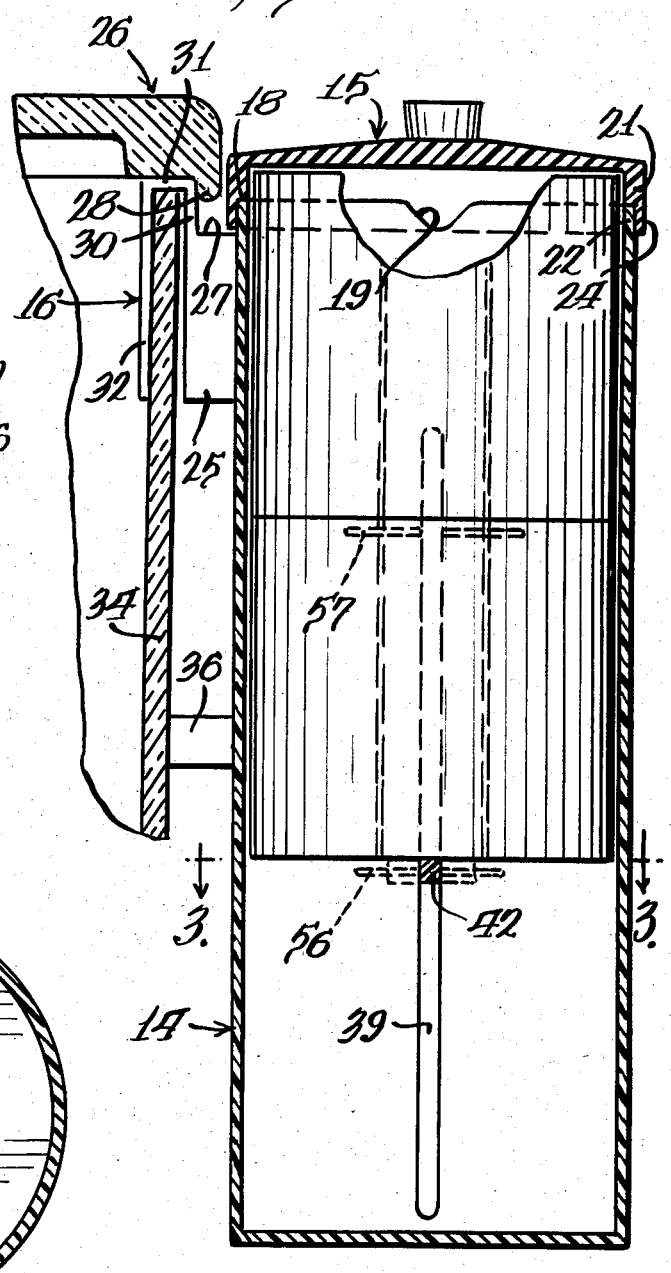
FIG. 2 is an enlarged longitudinal fragmentary section of the present toilet paper holder and roll dispenser shown mounted over a toilet tank.
Figure 3:
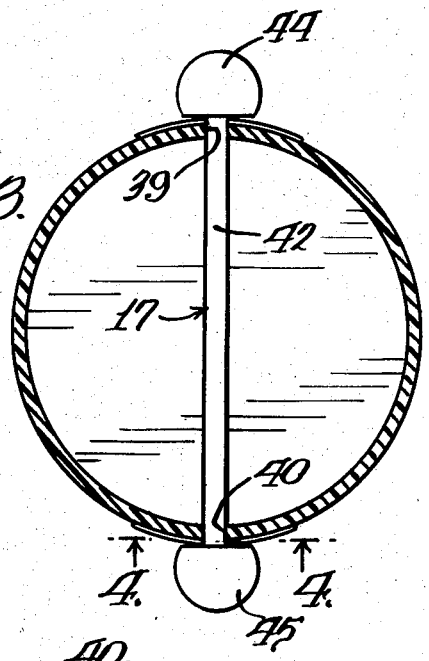
FIG. 3 is a cross-section taken generally along line 3—3 of FIG. 2 showing the actuator rod.

The tubular body member 14 has an axial length such that when three rolls of paper are positioned within the holder, with the acutuator rod 17 in its lowermost position, the upper roll will project slightly above the upper edge of the tubular body member 14 as represented in the position of the upper roll illustrated in FIG. 2. This permits the uppermost roll to be easily removed from holder 14. The body 14 has an annular upper edge 18 with semi-circular diametrally opposed recesses 19 therein that expose an additional portion of the upper roll in which the user's fingers may pass when grasping the upper roll during the removal process.

The cover 15 is also constructed of an injection moldable plastic and is seen to be cup-shaped in configuration with a depending flange 21 having a internal counterbore 22 therein that fits over and seats on the top rim 18 of the body 14. The flange 21 has a lower skirt portion 24 that fits over the outside of the tubular body member 14 and covers the recesses 19 so that they are normally hidden from view.

The bracket 16 is designed so that it may be integrally molded with the tubular body member 14 when the body is axially removed from the mold. Bracket 16 includes a horizontally extending portion 25 that spaces the tubular body 14 outwardly from tank cover 26, and this horizontally extending portion 25 has a vertical recess 27 in its upper surface that receives a vertically depending flange 28 on tank cover 26. The bracket 16 also includes a U-shaped portion consisting of an upwardly extending leg 30 from horizontal portion 25, a horizontal bite portion 31 that engages the top of the tank wall 34 and a depending vertical portion 32 that engages the inside of tank wall 34. It can be seen that bracket 16 is substantially concealed by the tank 11 and the tank cover 26. An integral projection 36 is molded with and extends from the tubular member 14 that engages the outside wall of the tank 11 to position and maintain the tubular body 14 along a vertical axis.

The actuator rod 17 is a one-piece plastic injection molding and is slidable in diametrally opposed axially extending slots 39 and 40 in the tubular body 14. Actuator rod 17 has a straight central portion 42 having a rectangular cross-sectional configuration and a length slightly greater than the outer diameter of the tubular body 14. Rod 17 has flat, enlarged arcuate end portions 44 and 45 that may be grasped by the user's index finger and thumb during manipulation.

Figure 4:
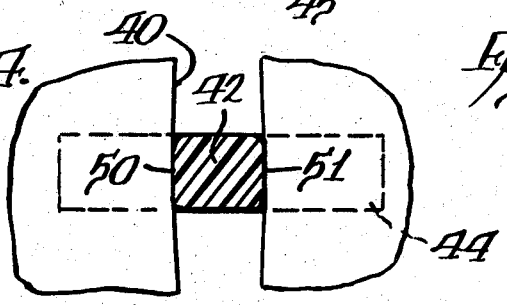
FIG. 4 is an enlarged fragmentary section of the actuator rod in its locking position.
Figure 5:
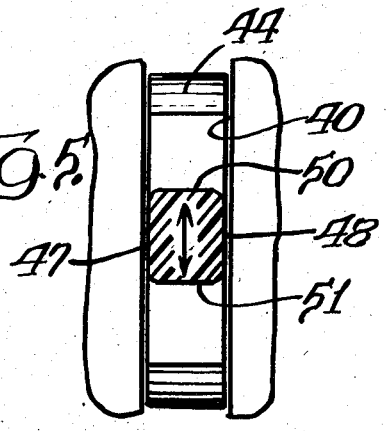
FIG. 5 is a fragmentary section illustrating the actuator rod in its sliding position.

As seen in FIGS. 4 and 5, the central portion 42 of the rod 17 is rectangular in configuration and has a width between the side faces 47 and 48 slightly less than the slots 39 and 40 for easy sliding movement in the slots, and a width between side surfaces 50 and 51 slightly greater than the width of the slots so that when the rod is rotated to its position illustrated in FIG. 4, the side edges 50 and 51 will slightly deform the sides of the slots, wedging the rod 17 therein and locking it in any desired position along slots 39 and 40.

In use, with three rolls in the body 14 and the rod 17 at the lower end of slots 39 and 40, and after the top roll has been removed, the user raises the rod 17 with the rod rotated to its position illustrated in FIG. 5 moving the lower two rolls upwardly until the FIG. 2 position is reached, and in this position the user rotates rod 17 in either direction 90 degress to its position illustrated in FIG. 4, locking the rod in position and holding the final two rolls in the position illustrated in FIG. 2. Indicator lines 56 are provided on either side of slot 40 to indicate the two-roll position of the actuator rod 17 and indicator marks 57 are provided on either side of the slot 40 to indicate the single roll position of rod 17, so that the uppermost roll is always slightly above the top of the tubular body member 14 in the position of the upper roll illustrated in FIG. 2 for easy removal, even though the cover 15 may be in position during movement of the rod 17 so the actual position of the upper roll would not be known without cover removal.

Figure 6:
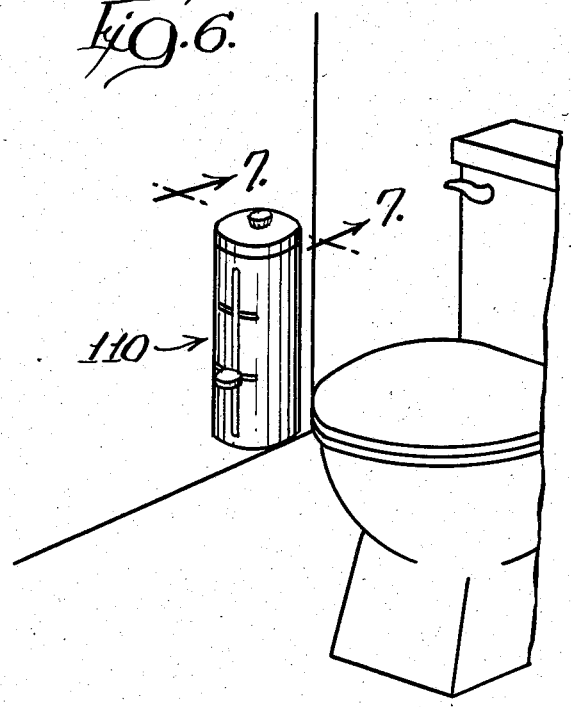
FIG. 6 is a perspective view of another embodiment of the present toilet paper holder and roll dispenser shown in a water closet area.
Figure 7:
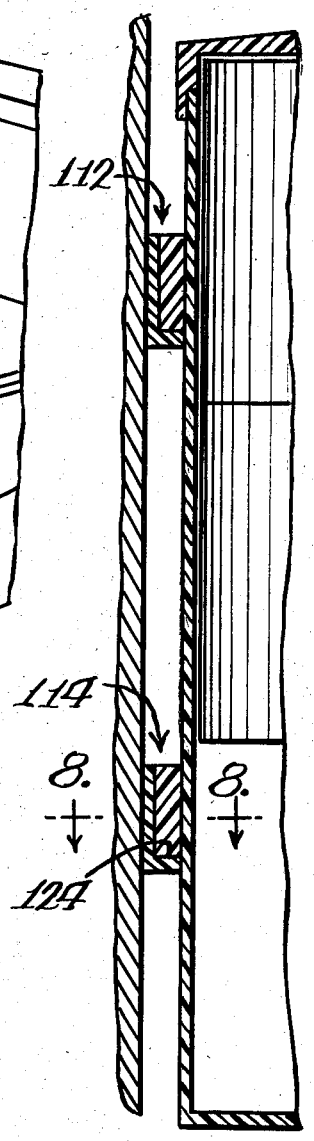
FIG. 7 is an enlarged longitudinal fragmentary view taken generally along line 7—7 of FIG. 6 illustrating the wall mounting brackets for the embodiment illustrated in FIG. 6.
Figure 8:
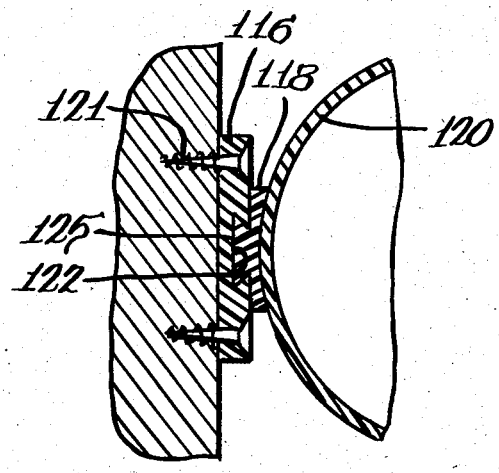
FIG. 8 is a fragmentary section taken generally along line 8—8 of FIG. 7 illustrating the dovetailed construction of the wall mount brackets in the embodiment of FIGS. 6 and 7.

A second embodiment of the present invention is illustrated in FIGS. 6 to 8 and is seen to be a toilet paper holder and roll dispenser 110 identical in construction to the toilet paper holder and dispenser illustrated FIGS. 1 to 5 except for wall-mounting bracket assembly 112 and 114. The brackets 112 and 114 are identical and each include a plastic wall plate 116 and a cooperating holder bracket 118 also constructed of plastic and the latter may be either integrally molded with tubular body 120 or sonic welded thereto after molding. The wall-mounted bracket 116 has a plurality of apertures therein that receive fasteners 121 to affix the bracket wall plate 116 to a suitable position in the water closet area of the washroom such as illustrated in FIG. 6. Plate 116 has a undercut dovetail vertical recess 122 therein that has a closed bottom end 124 for limiting downward movement of holder bracket 118 therein. Recess 122 receives a complementary undercut dovetail projection 125 on bracket 118.

Brackets 112 and 114 permit the tubular body 120 to be easily mounted to the wall in a fashion that permits removal of the tubular body 120 when desired simply by lifting the tubular body vertically upwardly, sliding the brackets 118 our of the recesses 122 in the wall plates 116; and of course it is simply remounted to the wall by reinserting the brackets 118 into the wall brackets 116.

We claim:

1. A toilet paper dispenser for holding and dispensing rolls of paper comprising: an elongated tubular body member having a length at least as great as the axial length of two rolls of toilet paper, said tubular body member having a closed end and an open end, said tubular body member being adapted to slidably receive at least two rolls of toilet paper, a removable cover for the open end of the tubular body member so that the rolls of paper are concealed when the cover is in place, and means for axially moving the rolls of paper in the tubular body member toward the open end thereof so that the roll adjacent the open end can be easily removed therefrom, said means for axially moving the rolls of paper including a selectively axially movable member extending through the tubular body member.

2. A toilet paper dispenser for holding and dispensing rolls of paper as defined in claim 1, including a bracket projecting from the tubular body member adapted to fit over the top rim of a conventional residential toilet tank under the tank cover for supporting the holder and dispenser on the toilet.

3. A toilet paper dispenser for holding and dispensing rolls of paper comprising: an elongated tubular body member having a length at least as great as the axial length of two rolls of toilet paper, said tubular body member having a closed end and an open end, said tubular body member being adapted to slidably receive at least two rolls of toilet paper, a removable cover for the open end of the tubular body member so that the rolls of paper are concealed when the cover is in place, means for axially moving the rolls of paper in the tubular body member toward the open end thereof so that the roll adjacent the open end can be easily removed therefrom, a bracket projecting from the tubular body member adapted to fit over the top rim of a conventional residential toilet tank under the tank cover for supporting the holder and dispenser on the toilet, the bracket having a horizontal portion extending from the tubular body member having a length greater than the width of the tank cover fiange to stand-off the tubular body member from the tank, said horizontal portion having a vertical recess in the top thereof for receiving the tank cover flange, and said bracket having a "U" shaped portion extending from the horizontal portion that fits over the tank top rim.

4. A toilet paper dispenser for holding and dispensing rolls of paper as defined in claim 3, including a projection extending from the tubular body member substantially axially below and angularly aligned with the bracket engageable with the side of the toilet tank to maintain the tubular body member in a vertical position.

5. A toilet paper dispenser for holding and dispensing rolls of paper comprising: an elongated tubular body member having a length at least as great as the axial length of two rolls of toilet paper, said tubular body member having a closed end and an open end, said tubular body member being adapted to slidably receive at least two rolls of toilet paper, a removable cover for the open end of the tubular body member so that the rolls of paper are concealed when the cover is in place, means for axially moving the rolls of paper in the tubular body member toward the open end thereof so that the roll adjacent the open end can be easily removed therefrom the means for axially moving the rolls of paper in the tubular body member including an axial slot in the tubular body member, and a manually manipulable rod axially slidable in the slot and extending under the adjacent roll of paper in the tubular body member.

6. A toilet paper dispenser for holding and dispensing rolls of paper as defined in claim 5, wherein the rod has a cross sectional portion thereof with a width greater than the width of the slot in the tubular body member, said rod being rotatable in the slot so that the user may axially move the rod and rolls to the desired position and rotate the rod so that the portion of the rod wedges in the slot holding the rod and rolls in the desired position.

7. a toilet paper dispenser for holding and dispensing rolls of paper as defined in claim 6, wherein the rod is rectangular in cross-section, a second slot in said tubular body member diametrally opposed to and indentical to the first slot, said rod extending through the first and second slots.

8. A toilet paper dispenser for holding and dispensing rolls of paper, comprising: an elongated tubular body member having a length at least as great as the axial length of two rolls of toilet paper, said tubular body member having a closed end and an open end, said tubular body member being adapted to slidably receive at least two rolls of toilet paper, a removable cover for the open end of the tubular body member so that the rolls of paper are concealed when the cover is in place, a bracket extending from the tubular body member adapted to fit over the tank of a conventional residential toilet tank and under the tank cover therefor, and a selectively axially movable member extending through the tubular body member under the roll adjacent the closed end of the tubular body member for moving the paper rolls toward the open end of the tubular body member.

9. A toilet paper dispenser for holding and dispensing rolls of paper comprising: an elongated tubular body member having a length at least as great as the axial length of two rolls of toilet paper, said tubular body member having a closed end and an open end, said tubular body member being adapted to slidably receive at least two rolls of toilet paper, a removable cover for the open end of the tubular body member so that the rolls of paper are concealed when the cover is in place, a selectively axially movable member extending through the tubular body member under the roll adjacent the closed end of the tubular body member for moving the paper rolls toward the open end of the tubular body member, and means for locking said axially movable member in any desired axial position along a substantial portion of the length of the tubular body member.

10. A toilet paper dispenser for holding and dispensing rolls of paper, comprising: an elongated tubular body member having a length at least as great as the axial length of two rolls of toilet paper, said tubular body member having a closed end and an open end, said tubular body member being adapted to slidably receive at least two rolls of toilet paper, a removable cover for the open end of the tubular body member so that the rolls of paper are concealed when the cover is in place, a bracket extending from the tubular body member adapted to fit over the tank of a conventional residential toilet tank and under the tank cover therefor, and a selectively axially moveable member extending through the tubular body member under the roll adjacent the closed end of the tubular body member for moving the paper rolls toward the open end of the tubular body member, said axially movable member being lockable in any desired axial position along a substantial portion of the length of the tubular body member, the bracket having a horizontal portion extending from the tubular body member having a length greater than the width of the tank cover flange to stand-off the tubular body member from the tank, said horizontal portion having a vertical recess in the top thereof for receiving the tank cover flange, and said bracket having a "U" shaped portion extending from the horizontal portion that fits over the tank top, a projection extending from the tubular body member substantially axially below and angularly aligned with the bracket engageable with the side of the toilet tank to maintain the tubular body member in a vertical position.

* * * * *